United States Patent [19]

Clark

[11] 4,314,721

[45] Feb. 9, 1982

[54] SECURITY BAR FOR SLIDING DOOR OR WINDOW

[75] Inventor: John D. Clark, Mt. Clemens, Mich.

[73] Assignee: Larry Raymond Praet, Port Huron, Mich. ; a part interest

[21] Appl. No.: 91,096

[22] Filed: Nov. 5, 1979

[51] Int. Cl.[3] ..... E05D 13/04

[52] U.S. Cl. ..... 292/262; 292/DIG. 49

[58] Field of Search ..... 292/209, 275, 338, 339, 292/262, DIG. 15, DIG. 49

[56] References Cited

U.S. PATENT DOCUMENTS

| | | | |
|---|---|---|---|
| 978,004 | 12/1910 | Burton | 339/258 F X |
| 2,702,205 | 2/1955 | Germain | 292/275 X |
| 2,703,395 | 3/1955 | Long | 339/258.3 X |
| 3,328,920 | 7/1967 | Cohen et al. | 292/DIG. 46 |
| 3,698,754 | 10/1972 | Means | 292/DIG. 46 |
| 3,737,186 | 6/1973 | Cheyem | 292/DIG. 15 |
| 3,805,322 | 4/1974 | Serrano | 292/DIG. 15 |
| 3,821,884 | 7/1974 | Walsh | 292/262 X |

*Primary Examiner*—Richard E. Moore

*Attorney, Agent, or Firm*—Hauke and Patalidis

[57] ABSTRACT

A security bar for securely holding in a closed position a horizontally sliding door, such as a so-called patio door, for example, or a horizontally or vertically sliding window. The security bar of the invention consists of a massive metallic or plastic bar member, preferably square or rectangular in cross-section, pivotally supported at one end by means of a bracket from an inoperative position to an operative position wherein the free end of the bar member is supported by a clip with the longitudinal axis of the bar member substantially orthogonal to the rear edge of the frame of the sliding door or window and to a fixed structural surface such as the door or window jamb. Both ends of the bar member are formed with a curvilinear or cylindrical surface providing line engagement with the surfaces held apart by the bar member, such that any load resulting from an attempt to slide open the door or window is applied directly to the bar member in compression and not as a shear force applied through intermediary fastening members such as pivot pins or the like. When in an inoperative position, the bar member is held out of the way by a clip fastened to the same surface as the pivot support bracket.

9 Claims, 7 Drawing Figures

SECURITY BAR FOR SLIDING DOOR OR WINDOW

BACKGROUND OF THE INVENTION

The invention relates generally to security devices for sliding doors or windows, and more particularly to manually operable jamming or locking bars adapted to prevent sliding doors or windows from being opened from the outside of a building.

Sliding windows and sliding doors such as glass doors, or so-called patio doors, as commonly used in buildings such as dwelling houses, present the disadvantage of being easily forced open from the outside by intruders. Vertically sliding windows and horizontally sliding windows are generally held shut by a rather weak rotary latch, and sliding glass doors, or patio doors, are generally held closed by a lever-actuated latch, accessible from the inside of the building. Both types of latches can easily be broken by leverage exerted from the outside between the jamb and the door or window frame.

SUMMARY OF THE INVENTION

The present invention provides a security bar for sliding windows or doors which, when in securing position, is positioned between the free or dorsal edge of the window or door frame and the window or door jamb, with its axis extending substantially perpendicular to the substantially parallel surfaces of the frame dorsal edge and the jamb. The bar is provided with a curvilinear or cylindrical surface at each of its ends. The curvilinear or cylindrical end surface provides a line engagement with the plane surfaces of the dorsal edge and jamb, respectively, or with the plane surfaces of appropriate support members fastened respectively to the dorsal edge of the sliding member and on the surface of the jamb. The result of such a structure is that all the load forces exerted on the bar are compression forces, no shear force is exerted on hinges or pivot pins, and no twisting force is applied to any bracket, when the window or door is attempted to be forced open by leverage from the outside of the building.

The many objects and advantages of the present invention will become apparent to those skilled in the art when the following description of the best modes contemplated for practicing the invention is read in conjunction with the accompanying drawing wherein like numerals refer to like or equivalent parts and in which:

DETAILED DESCRIPTION OF THE PREFERRED EMBODIMENTS

Figures 1, 2, 3, 4, 5, 6, 7:
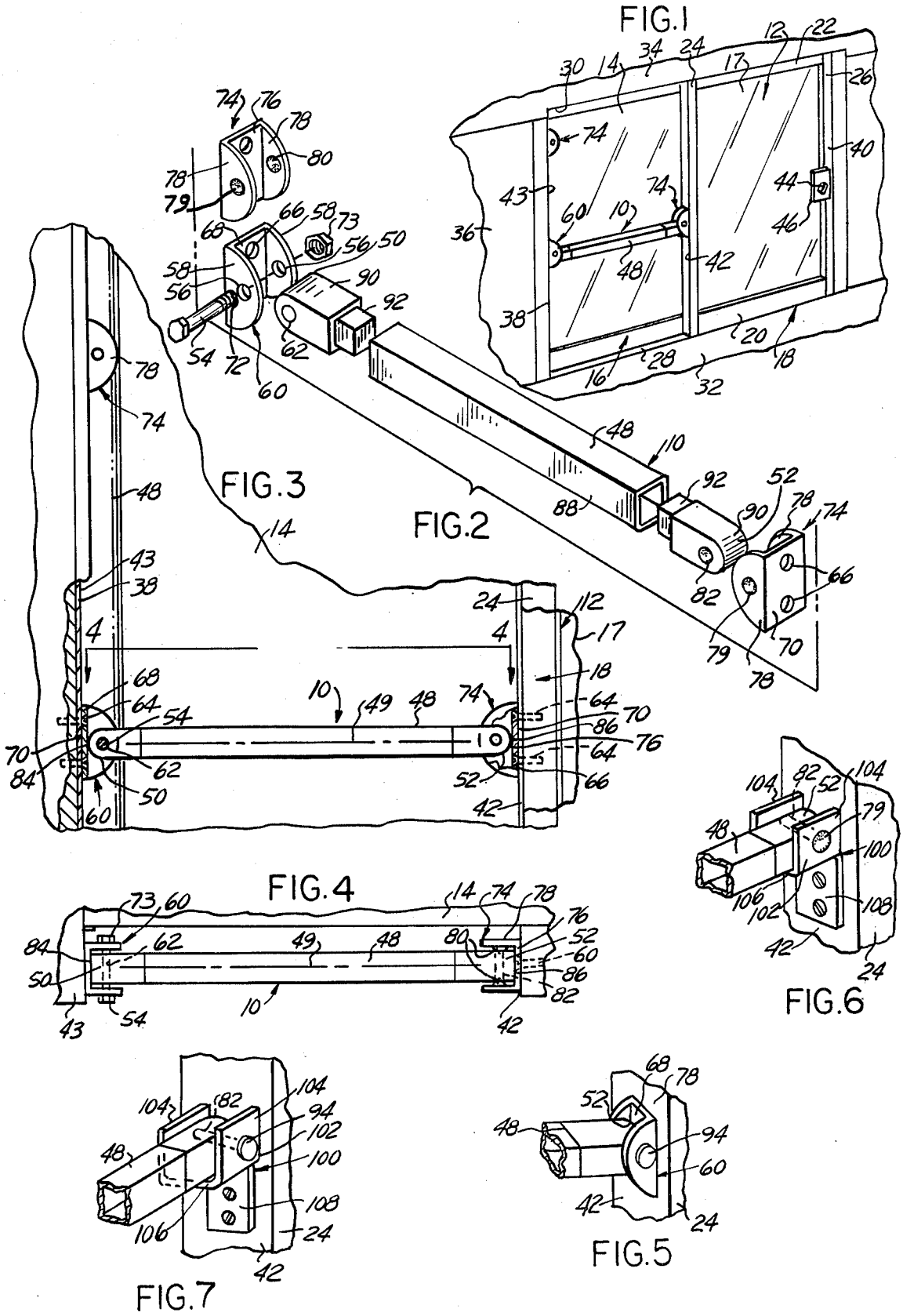
FIG. 1 is a perspective schematic view of a sliding door, such as a patio door, as seen from the inside of a building, and showing a security bar according to the invention in operative position.
FIG. 2 is an exploded view of an example of structural embodiment of a security bar system according to the present invention.
FIG. 3 is a fragmentary enlarged elevational view of the installation illustrated at FIG. 1, with portions cut away to show the internal structure.
FIG. 4 is a fragmentary top elevational view as seen from line 4—4 of FIG. 3.
FIG. 5 is a fragmentary perspective view of a modification thereof.
FIGS. 6 and 7 are fragmentary perspective views of further modifications thereof.

Referring to the drawing and more particularly to FIG. 1, the invention is a security bar 10 maintaining a sliding glass door 12, such as for example a patio glass door, securely closed when the security bar 10 is disposed in its operative position, as shown. Although the invention is shown and described hereinafter for use with a glass sliding door for holding the glass sliding door securely in a closed position, when so desired, it will be readily appreciated that the example of application of the invention in combination with a sliding glass door, such as a patio door, is given for illustrative purpose only, and that the invention, instead of being used for holding in a closed position a horizontally sliding door as the glass patio door 12 of FIG. 1 can be used for securing in a closed position a horizontally sliding window or a vertically sliding window, for example.

In addition to the horizontally sliding glass door 12, a sliding glass door installation, such as a patio door installation, comprises a permanently fixed glass panel 14 provided with an appropriate metallic frame 16. The sliding glass door 12 also comprises a glass panel 17 provided with a metallic frame 18 consisting of a lower frame member 20, an upper frame member 22, and a pair of lateral frame members 24 and 26. The upper and lower frame members 20–22 are provided at their edge with appropriate rollers, not shown, or other means permitting the frame 18 to be horizontally slidable relative to a lower rail member 28 and an upper rail member 30. The rail members 28 and 30 are mounted respectively on the floor 32 of a building, such as a house, and below a horizontal upper jamb member 34 of an appropriate opening in a wall 36. The opening in the wall 36 is framed by a pair of substantially parallel vertical jamb members 38 and 40. The glass door 12 is thus horizontally slidable from a position whereby the edge or dorsal face 42 of the glass door lateral frame member 24 adjoins the surface 43 of the vertical jamb member 38, with the movable glass panel 17 disposed substantially parallel to the fixed glass panel 14 on the inside of the room, to the position illustrated whereby the glass panel frame 18 of the door 12 is slid in the closed position with the edge of its lateral frame member 26 abutting the vertical jamb member 40, generally provided with a fixed molding rail. The slidable glass door 12 is held in the closed position by an appropriate latch operated by, for example, a lever 44 mounted on a handle 46.

As shown in detail at FIGS. 2–4, the security bar 10 of the invention comprises a bar member 48, preferably square or rectangular in cross-section, made of metal such as steel or aluminum, or made of plastic, provided with partially curvilinear or cylindrical end faces 50 and 52. The bar member 48 is pivotably held proximate its curvilinear or cylindrical end face 50 by means of a pivot bolt 54 passed through aligned holes 56 disposed in the substantially parallel sidewalls 58 of a U-shaped bracket 60 fastened to the surface 43 of the vertical jamb member 38, the pivot bolt 54 passing through a transverse bore 62 disposed through the bar member 48 proximate its curvilinear or cylindrical end face 50. The U-shaped bracket 60 is fastened to the surface 43 of the vertical jamb member 38 by means of a pair of screws 64 passed through appropriate mounting holes 66 through the bottom portion 68 of the U-shaped bracket 60. The outer surface of the bottom portion 68 of the U-shaped bracket 60 is preferably provided with a coating 70 of adhesive, normally protected by a length of release paper, not shown, such that by peeling off the release paper and applying the coated surface against the surface of the vertical jamb member 38, the U-shaped bracket 60 may be held fastened to the surface 43 of the vertical jamb member without mounting screws, or both means of attaching the bracket 60 to the surface 43 of the vertical jamb member 38 may be used, if so desired. The end of the pivot bolt 54 is threaded, as shown at 72 in the exploded view of FIG. 2, such that the pivot bolt 54 may be secured in position, with its body passed through the support bracket sidewall holes 56 and the bar member transverse bore 62, by way of a nut 73 threaded over the threaded end 72 of the pivot bolt. A U-shaped clip 74 is fastened to the dorsal face 42 of the lateral frame member 24 of the sliding glass door 12. The clip 74 is mounted on the dorsal face 42 of the door vertical frame member 24, at substantially the same height and opposite the pivot bracket 60 mounted on the surface of the door jamb member 38, by means of a pair of mounting screws 64 passed through appropriate mounting holes 66 disposed through its bottom portion 76, a coating of adhesive protected by a peelable release paper being also preferably provided on the exterior surface of the bottom portion 76 for alternate or auxiliary mounting on the dorsal face 42 of the door vertical frame member 24. The spring clip 74 has a pair of substantially parallel springingly spreadable sidewalls 78, each sidewall 78 being provided with a dimple 79 forming an inwardly projecting protruberance 80 springingly engageable in a corresponding recess 82, which may take the form of a transverse bore, disposed in each side of the bar member 48 proximate its curvilinear or cylindrical end face 52.

When placed in position to prevent the sliding door 12 from being forcibly opened, the bar member 48 is disposed substantially horizontally between the support pivot bracket 60 and the spring clip 74, with its longitudinal axis 49 substantially perpendicular to the surface of the dorsal face 42 of the sliding door lateral frame member 24 and to the surface 43 of the vertical jamb 38. The shape and the dimensions of the diverse elements are such that the bar member curvilinear or cylindrical end faces 50 and 52 engage respectively the surface of the bottom portions 68 and 76 of, respectively, the bracket 60 and the spring clip 74 along lines 84 and 86, respectively. Consequently, any force applied from the exterior to the sliding door 12 to force it open is taken in compression by the bar member 48, and there is no shear force exerted on any of the elements. For that purpose, it is preferable to have a relatively loose fit between the pivot bolt 54 and the holes 56 in the sidewalls 58 of the bracket 60, and between the pivot bolt 54 and the transverse bore 62 proximate the curvilinear or cylindrical end face 50 of the bar member 48, such that the pivot bolt 54 only supports the end of the bar member 48 in position, when placed horizontally for securing the sliding door 12 shut. The pivot bolt 54 also conveniently supports the bar member 48 for pivotal motion from the securing position illustrated in FIGS. 1 and 3–4, to a position shown in phantom line at FIG. 3 wherein the bar member 48 is held vertically out of the way with its curvilinear or cylindrical end 52 held between the sidewalls 78 of a second spring clip 74 mounted on the surface 43 of the vertical door jamb member 38 an appropriate distance from the pivot bracket 60.

The spring clips 74 may be made of metal such as aluminum but preferably they are made of relatively resilient plastic or of spring steel. The pivot support bracket 60 may be made of metal or plastic and the bar member 48 may be solid, or it may be made of a tubular body member 88, as best shown at FIG. 2, provided with a pair of end pieces 90 each having a reduced diameter portion 92 adapted to be press-fitted within the ends of the tubular member 88, or otherwise fastened by cementing or by way of a mounting pin, not shown, or the like. The security bar 10 of the present invention being intended to be supplied in the form of a universal kit comprising all the elements illustrated in exploded view at FIG. 2, one of the advantages resulting from the bar member 48 being made of a tubular member 88 provided with separate end pieces 90 is that the tubular member 88 may be easily shortened by sawing to an appropriate length such as to make it adaptable to diverse door or window opening sizes. Convenient dimensions for the bar member 48 made of steel, plastic or preferably aluminum are $\frac{3}{4}\times\frac{3}{4}$ in. to $1\times1$ in., preferably square in section, and, when a tubular portion 88 is provided, the tubular portion 88, of the same dimensions, has a wall thickness in the range of approximate $\frac{1}{8}$ in. to $\frac{1}{4}$ in.

Alternatively, and as illustrated at FIG. 5, the spring clip may be replaced by a U-shaped bracket identical to the bracket 60, a bolt or pin 94 being used for holding the bar 48 in operative position proximate its curvilinear or cylindrical end face 52. In this arrangement, it is also important that the fitting between the pin 94 and the holes in the sidewalls of the U-shaped bracket 60 and through the transverse bore proximate the curvilinear or cylindrical end face 52 of the bar member 48 be such that, when the bar member 48 is placed in operative position to prevent opening of the sliding door or window, the curvilinear or cylindrical end face 52 is engaged with the surface of the bottom portion of the U-shaped bracket.

Alternatively, and as shown at FIG. 6, the support clip for the cylindrical end 52 of the bar member 48 may consist of a clip 100 generally shaped as a channel member 102 having a pair of substantially parallel sidewalls 104 and a bottom portion 106 integrally formed with a right angled mounting flange 108 fastened to the dorsal face 42 of the sliding door lateral frame member 24. The bottom portion 106 of the clip 100 supports the bottom of the bar member 48, and the lateral surfaces of the bar member 48 are springingly engaged between the sidewalls 104, each of the sidewalls 104 being provided with a dimple 79 forming on the interior surface a protruberance, not shown, which engages the recess or transverse bore proximate the curvilinear or cylindrical end face 52 of the bar member 48. In such an arrangement, the curvilinear or cylindrical end face 52 of the bar member 48 directly engages, along a line contact, the surface of the dorsal face 42 of the sliding door lateral frame member 24. The dimples 79 in the clip sidewalls 104 may be replaced by holes and a pin 94, FIG. 7, passed through the holes and a transverse bore 82 through the bar member 48 used for holding the end of the bar member. Such a structure may also alternatively be used to pivotally hold the other end of the bar member 48 with the result that the curvilinear or cylindrical end faces 50 and 52 of the bar member 48 engage directly, through a line contact, the surface 43 of the vertical fixed jamb member 38 and the dorsal face 42 of the movable door frame member 24.

It will be appreciated that the security bar 10 of the invention provides for the bar member 48 extending substantially horizontally in installations for securing a sliding door, or the like, which is arranged to open by sliding horizontally, and that the bar member 48 will be installed such as to be substantially vertical for immobilizing in its shut position a vertically slidable panel member such as a vertically slidable window or the like. Preferably, the bar member 48 extends, when in its securing position, such that its curvilinear or cylindrical end face 52 abuts through a line contact substantially at the center of the dorsal face of the marginal frame of the sliding panel. However, in some installations, because the distance between the dorsal face of the marginal frame of the sliding panel and the surface of the jamb member on which the other end of the bar member 48 abuts is relatively short, it may be necessary to install the security bar 10 out of center, and it may be desirable to provide two or more such security bar installations, for example one disposed at the bottom and another at the top of a sliding door, one of the bar members pivoting from the jamb and the other pivoting from the dorsal face of the lateral frame member of the sliding panel. Also, although it is preferable to have the bar member 48 pivot from a stationary jamb, the arrangement may be reversed, and the pivot bracket 60 may be mounted on the dorsal face of the sliding panel lateral frame member, together with a spaced apart holding clip 74 for holding the free end of the bar member 48 in its non-operative position.

Having thus described the present invention by way of examples of structural embodiments thereof, modifications whereof will be apparent to those skilled in the art, what is claimed as new is as follows:

1. A security bar for holding in a closed position a sliding panel provided with a frame dorsal surface adapted to be displaced substantially parallel to a jamb surface toward and away from said jamb surface during opening and closing of said panel, said safety bar comprising a bar member having each end formed with a curvilinear cylindrical face, and means at each end of said bar member for holding said bar member in an operative position preventing said frame dorsal surface of said sliding panel from being displaced towards said jamb surface with the longitudinal axis of said bar member substantially perpendicular to said frame dorsal surface and said jamb surface, wherein said means holding said bar member in said operative position comprises a pivotal support attached to one of said surfaces and a clip attached to the other of said surfaces, said pivotal support comprising a substantially U-shaped bracket member attached to said one of said surfaces and a pair of substantially parallel sidewalls one disposed on each side of said bar member at an end thereof, and a pivot pin member engaged through aligned apertures in said sidewalls and through said bar member proximate one of said curvilinear cylindrical end faces, and said clip comprises a generally U-shaped member having a mounting portion fastened to said other of said surfaces, said generally U-shaped member having a pair of opposite substantially parallel sidewalls each disposed on one side of said bar member and means in said clip sidewalls engageable with said bar member proximate the other of said curvilinear cylindrical end faces for supporting said bar member, wherein said apertures in said bracket member sidewalls, said pivot pin member and said supporting means in said clip are arranged to allow each curvilinear cylindrical end face of said bar member to provide line engagement with a planar surface corresponding to one of said surfaces and for opposing motion of one of said surfaces toward the other, and to cause said bar member to absorb in compression forces causing said motion, with said lines of engagement aligned substantially with said bar member longitudinal axis.

2. The security bar of claim 1 wherein said means in said clip sidewalls engageable with said bar member comprises a protuberance in each of said sidewalls projecting towards said bar member and springingly engageable in a corresponding recess in each side of said bar member.

3. The security bar of claim 1 wherein the face of said bracket member bottom portion is coated with an adhesive for engagement with one of said surfaces.

4. The security bar of claim 1 wherein said clip U-shaped member has a face in engagement with said surface provided with a coating of adhesive for attachment thereto.

5. The security bar of claim 1 further comprising a second clip mounted on the same surface as said pivotable support member, said second clip being disposed such as to provide means for springingly holding said bar member with its longitudinal axis substantially parallel to said surface.

6. The security bar of claim 1 wherein said bar member is substantially rectangular in cross-section.

7. The security bar of claim 1 wherein said bar member is substantially square in cross-section.

8. The security bar of claim 1 wherein said bar member comprises an open ended tubular member and a pair of end portions each fitted at an end thereof and provided with said curvilinear face.

9. The security bar of claim 1 wherein said means in said clip sidewalls engageable with said bar member comprises a removable pin member passed through an aperture disposed in each of said sidewalls and through a transverse bore in said bar member.

* * * * *